United States Patent [19]

Sharland et al.

[11] 4,134,162

[45] Jan. 16, 1979

[54] DISPOSABLE DRAIN STRAINER

[76] Inventors: Stanley G. Sharland, 12322 Quartz Pl., CA, 92643; Angelo R. Mecca, 956 Senate St., Costa Mesa, Calif. 92627; Robert R. Masson, Box 241, Yorba Linda, Calif. 92686

[21] Appl. No.: 831,079

[22] Filed: Sep. 6, 1977

[51] Int. Cl.[2] ..... E03C 1/26

[52] U.S. Cl. ..... 4/292; 4/293

[58] Field of Search ..... 4/292, 190, 293, 286–291, 4/109

[56] References Cited

U.S. PATENT DOCUMENTS

| | | | |
|---|---|---|---|
| 1,880,962 | 10/1932 | Koppelman | 4/109 |
| 3,402,407 | 9/1968 | Andrews | 4/293 |
| 3,788,485 | 1/1974 | Bruning | 4/292 |

*Primary Examiner*—Charles E. Phillips
*Assistant Examiner*—Willis Little
*Attorney, Agent, or Firm*—William C. Babcock

[57] ABSTRACT

A drain strainer that includes a vacuum cup defining a ring-shaped base that has an inverted generally conical first shell projecting upwardly therefrom, which shell has a number of circumferentially and vertically spaced first drain openings therein that are of substantial area. Due to the vacuum cups forming a part thereof, the base may be removably secured to the bottom of a sink to encircle the drain discharge formed in the latter. The external surface of the shell and the upper surface of the base merge into a downwardly and inwardly extending ring-shaped area in which stringy material such as hair, and the like, will accumulate rather than passing through the first drain openings. When it is desired to restrict the size of solid particles passing to the discharge opening, a second generally conical shell formed from metal foil, or the like, overlies the first shell, with the second shell having a number of spaced second drain openings formed therein that are radially aligned with the first drain openings but are of substantially smaller area. The second shell is removably supported on the first shell, and this second shell is so inexpensive that it may be discarded when it becomes clogged with foreign material.

A punch and forming die is provided that permits the second shell to be formed from a circular blank of a metal foil, such as aluminum, or the like. However, should it be desired, the second shells may be preformed, and removably secured to the first shell when the occasion so requires.

3 Claims, 7 Drawing Figures

FIG. 1
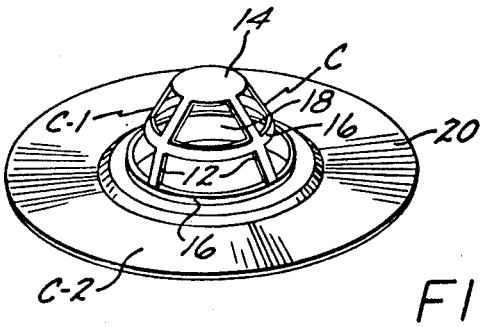
FIG. 7
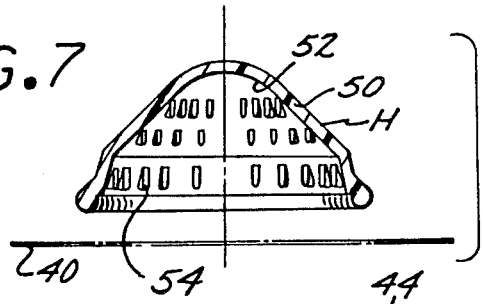
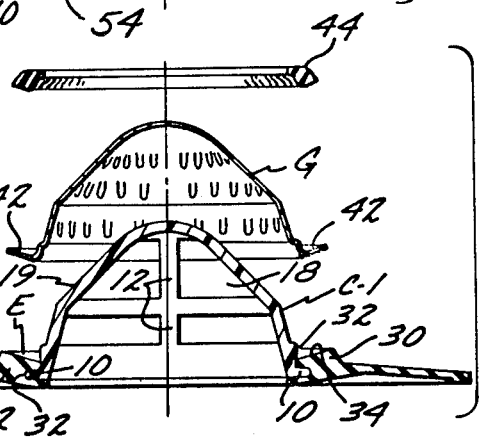
FIG. 2
FIG. 3
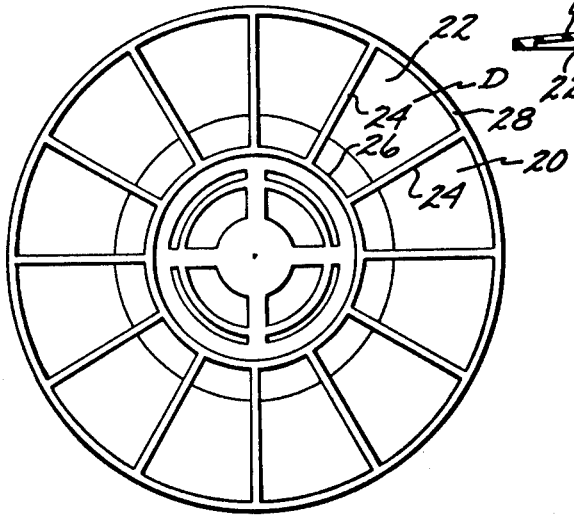
FIG. 5
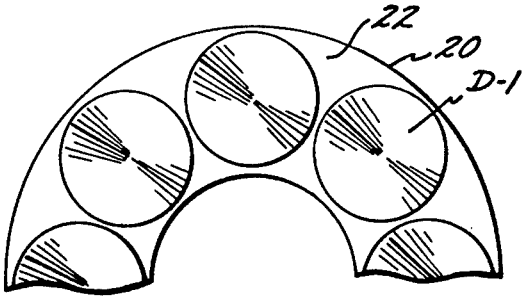
FIG. 4
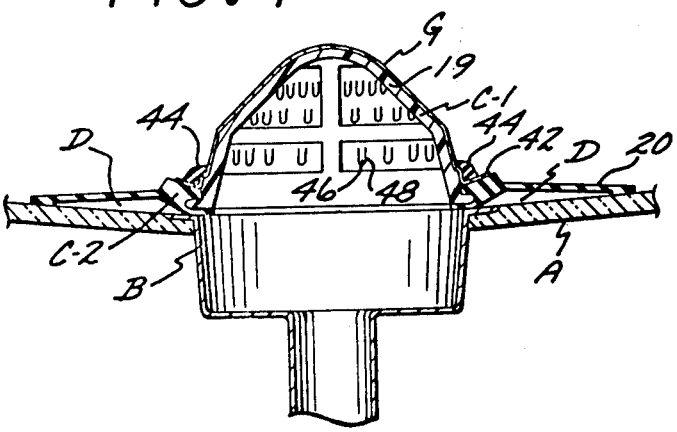
FIG. 6
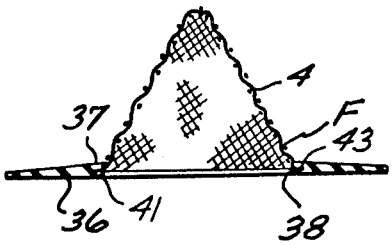

DISPOSABLE DRAIN STRAINER

BACKGROUND OF THE INVENTION

1. Field of the Invention

Disposable drain strainer.

2. Description of the Prior Art

In the conventional present day sink, the drain discharge opening is recessed and has an apertured strainer situated therein. Solid particles in the water in the sink as the water discharges, accumulate on the strainer and block or impede the flow of water therethrough.

The primary purpose of the present invention is to provide a first drain strainer that is removably securable to the bottom of the sink to encircle the drain discharge opening therein, with the first drain strainer extending above the bottom of the sink to minimize the quantity of particles above a certain size that accumulate in such a configuration that passage of water through the strainer is blocked. In addition, when solid material has accumulated around the first strainer to the extent that the flow of water therethrough is seriously impeded, the strainer is removable for cleaning purposes.

Another object of the invention is to provide a second strainer that has second openings formed therein that are of smaller cross section than those in the first strainer, with the second strainer by the use of a punch and forming die, being formed from a circular blank of metallic foil, and this second strainer is removably mounted on the first strainer.

Yet another object of the second strainer is to furnish one that is sufficiently inexpensive that it may be discarded when it becomes clogged with particled material.

SUMMARY OF THE INVENTION

The invention includes a first strainer that has a ring-shaped vacuum cup defining base that is removably securable to the bottom of a sink to extend around the drain discharge opening formed therein. A first generally conical shell extends upwardly from the inner periphery of the ring-shaped base, with the first shell having a number of circumferentially and vertically spaced openings formed therein.

A punch and forming die is provided for transforming a circular blank of metallic foil into a generally conical second shell that is removably secured to the first shell and overlies the latter, with the second shell having a number of spaced drain openings formed therein that are radially aligned with the first drain openings but are of substantially smaller area than the openings in the first shell. The second shells are so inexpensive that they may be discarded when they become clogged with foreign material to the extent that water does not flow readily through the second drain opening.

Yet another object of the invention is to provide a drain strainer of such structure that stringy material such as hair tends to accumulate in the circumferential junction area between the first shell and base rather than passing through the first drain openings formed therein.

BRIEF DESCRIPTION OF THE DRAWING

FIG. 1 is a perspective view of the drain strainer that includes a ring-shaped vacuum cup defining base and a first generally conical shell extending upwardly therefrom in which first drain openings are defined;

FIG. 2 is a transverse cross sectional view of a second conical drain opening defining shell, and retaining ring that may be removably mounted on the drain strainer as illustrated in FIG. 4;

FIG. 3 is a bottom plan view of drain strainer shown in FIG. 1, illustrating the trapezoidal vacuum cups formed on the base;

FIG. 4 is a transverse cross-sectional view of the drain strainer shown in Figure illustrating a second conical shell of metal foil removably positioned thereon;

FIG. 5 is a fragmentary bottom plan view of the base shown in FIG. 1 illustrating an alternate form of vacuum cup;

FIG. 6 is a vertical cross-sectional view of a first alternate form of drain strainer; and FIG. 7 is a transverse cross sectional view of the combined punch and forming die and blank used therewith in forming the second drain opening defining shell shown in FIGS. 2 and 4.

DESCRIPTION OF THE PREFERRED EMBODIMENTS

The bottom portion A of a conventional sink is shown in FIG. 4 that has a recessed discharge drain B positioned therein, which discharge drain may have a first form of the disposable drain strainer C shown in FIG. 1 removably disposed thereabove.

Drain strainer C as shown in FIGS. 1 and 4 may be formed from numerous materials, preferably molded polymerized resin such as high impact styrene, ABS, or the like. Drain strainer C, as best seen in FIG. 4 is preferably formed from first and second interlocking portions C-1 and C-2 respectively.

The first portion C-1 is of generally conical configuration and includes a ring-shaped circular flange 10 that has a number of circumferentially spaced ribs 12 extending upwardly therefrom to merge at the top ends thereof in a cap 14. Two or more vertically spaced circumferential members 16 extend between the ribs 12, with the cap 14, ribs 12 and members 16 cooperatively defining a first generally conical shell 19 having a number of first generally rectangular drain openings 18 formed therein.

The second portion C-2 includes a ring-shaped circular web 20 that has a lower surface 22. A number of vacuum cups D are defined on the lower surface 22 by circumferentially spaced, radially extending ribs 24 that are joined on their inner and outer ends by first and second circular ribs 26 and 28 respectively. Web 20 has a thickened center portion 30 in which a circular groove 32 is formed, which groove interlocks with flange 10, as shown in FIGS. 2 and 4, to hold the first and second portions C-1 and C-2 in securement relation.

When the first and second drain strainer portions C-1 and C-2 are in interlocking engagement, as shown in FIG. 4, they have two circumferentially extending surfaces 32 and 34, respectively, as is seen in FIG. 2, that merge and define a circular downwardly and inwardly sloping area E in which stringy material such as hair, and the like (not shown), accumulates as water drains through the openings 18 into the drain discharge B. The first form of drain strainer C is removably secured to the upper surface of the sink bottom A by pressing the vacuum cups D into sealing engagement therewith, and the drain strainer overlies and surrounds the discharge opening B. When so disposed the first form of drain strainer B will allow relatively large particles of solid material (not shown) in the drain water to pass through the openings 18 and then be carried downwardly through the discharge opening B. Should it be desired, the web 20 may have circular vacuum cups D-1 formed on the lower surface 22 thereof, as shown in FIG. 5.

A modified form F of sink strainer is shown in FIG. 6 that includes a ring-shaped web 37 which may have either vacuum cups D or D-1 formed on the bottom surface 36 thereof. Web 37 has an inner circular periphery 38 in which a recess 41 is formed that engages a circular flange 43 on the base of an upwardly extending screen 4 that is of conical shape.

The modified form F of the sink strainer is used in the same manner as the first form C. Due to the small openings in screen 4, the modified form F of the sink strainer permits solid particles of solid material of small size (not shown) to pass therethrough to flow downwardly with the drain water into the discharge opening B. Web 37 is preferably formed from a polymerized resin such as high impact styrene, ABS, or the like.

By use of a second shell G, preferably formed from a circular blank 40 of sheet material such as aluminum foil, the size of the solid particles (not shown) that flow with the drain water to the drain discharge B can be restricted to a desired degree. The second shell G, as may be seen in FIG. 2, is of such generally conical shape as to overlie the first shell 19. Second shell G has an upwardly and outwardly extending circular flange 42 on the base thereof that is disposed in the area E. A resilient retaining ring 44 is provided, as may be seen in FIGS. 2 and 4, that removably engages the flange 42 and secures the second shell G to the first shell 19. Second shell G has a number of vertically and circumferentially spaced U-shaped tabs 46 formed therein that are pressed inwardly to provide second openings 48 in the shell which are in alignment with the openings 18 but are substantially smaller in area than the latter. The smaller drain openings 48 restrict the size of solid foreign particles (not shown) to a desired degree that can flow through the strainer C.

The second shell G is conveniently formed by smoothing the metal foil blank 40 over the first shell 19 and then bringing a punch and forming die H shown in FIG. 7, into overlying pressure contact therewith. The punch and forming die H is formed from a rigid body 50 having a concavity 52 formed therein that conforms to the external surface of the first shell 19. A number of circumferentially and vertically spaced teeth 54 project inwardly from the concavity and are transversely alignable with the first drain openings 18. When the punch and forming die H is pressed downwardly onto the plank 40 disposed on the first shell 19, the teeth 54 slit the blank to form the tabs 46 and force them inwardly to define the openings 48. When one of the second shells G becomes clogged with particles of solid material (not shown) it may be discarded due to the low cost thereof and replaced with a new second shell. The punch and forming die H may be used with a complementary die (not shown) to preform the second shell G whereby the preformed second shell G may then be mounted on the first shell 19 and removably held in place thereon by the resilient ring 44.

The use and operation of the invention have been explained previously in detail and need not be repeated.

What is claimed is:

1. In combination with a strainer capable of being removably mounted above a drain opening in the generally flat bottom of a sink, said strainer being of the type that includes a ring-shaped web that overlies the portion of said bottom adjacent said drain opening, a plurality of vacuum cups on said web that removably hold said web on said portion of said bottom, a generally conical first shell that extends upwardly, from an inner periphery of said ring-shaped web, and said shell having a plurality of circumferentially and vertically spaced first openings therein that prevent solid particles of greater size than said first openings moving therethrough to said drain opening, a device for further limiting the size of said solid particles that can pass through said strainer to said drain opening and one that will not clog by hair and stringy material, said device including:

a. a punch and forming die formed from a rigid body having a cavity formed therein that conforms to the external surface of said first shell, and a number of circumferentially and vertically spaced teeth projecting inwardly from said cavity;

b. a generally conical second shell formed by pressing said punch and forming die downwardly onto a metal foil blank disposed over said first shell, said second shell matingly engaging said first shell in removable securement thereto during an operational phase of said strainer combination when said punch and forming die has been removed, said second shell also having a plurality of second openings formed therein by said inwardly projecting teeth on said die, said openings being aligned with said first openings but are of substantially smaller area, said second shell including a flange member extending radially outward from a lower surface of said second shell; and c. first means for removably securing said second shell in place on said first shell, said first means being located in removable contact with said conical second shell for providing varying flow area through said strainer, said first means for removably securing said second shell including a resilient retaining ring member insertable over said second shell for engagement with said second shell flange member.

2. A drain strainer as defined in claim 1 wherein said vacuum cups are formed integrally with said web.

3. A drain strainer as defined in claim 1 wherein said first shell is formed from screen.

* * * * *